United States Patent [19]

Hansen et al.

[11] 4,086,972

[45] May 2, 1978

[54] METHOD AND APPARATUS FOR ROOF DRILLING

[75] Inventors: Lloyd B. Hansen, Bridgeport; Eugene R. Smarrella, Shinnston, both of W. Va.

[73] Assignee: Carmet Company, Pittsburgh, Pa.

[21] Appl. No.: 760,898

[22] Filed: Jan. 21, 1977

Related U.S. Application Data

[63] Continuation-in-part of Ser. No. 683,986, May 6, 1976, Pat. No. 4,009,760, which is a continuation of Ser. No. 554,878, Mar. 3, 1975, abandoned.

[51] Int. Cl.[2] ..... E21C 13/01; E21C 13/02; E21C 15/00; E21C 15/02

[52] U.S. Cl. ..... 175/65; 175/320; 175/393; 175/410

[58] Field of Search ..... 175/320, 323, 327, 393, 175/398, 410, 414, 415, 421, 422, 53, 57, 62, 65; 285/14, 45 B

[56] References Cited

U.S. PATENT DOCUMENTS

| | | | |
|---|---|---|---|
| 2,263,579 | 11/1941 | Hokanson | 175/320 X |
| 2,693,345 | 11/1954 | Martin et al. | 175/320 X |
| 2,753,155 | 7/1956 | Toms | 175/414 |
| 2,902,832 | 9/1959 | Levy et al. | 175/320 X |
| 2,979,141 | 4/1961 | Kandle | 175/62 X |
| 3,106,972 | 10/1963 | Thornsberry | 175/398 |
| 3,187,825 | 6/1965 | Bower, Jr. | 175/320 X |
| 3,283,837 | 11/1966 | McKain | 175/414 |
| 3,304,816 | 2/1967 | Galorneau | 175/320 X |
| 3,341,237 | 9/1967 | Anzalone | 175/320 X |
| 3,554,306 | 1/1971 | Wilburn | 175/320 |

*Primary Examiner*—Stephen J. Novosad
*Attorney, Agent, or Firm*—Vincent G. Gioia; Robert F. Dropkin

[57] ABSTRACT

An assembly for drilling a hole in a roof to a greater depth than the height of the chamber therebelow includes a starter-driver bar having a first end adapted to be driven by a motor and a second end having a female socket therein, a rod extension including a male end shaped to be received in said female socket and a female socket at its other end of the same cross-sectional size and shape as the first named female socket, and a bit having a male shank of the same general cross-sectional shape as said male end. The male shank which is received in the socket has a pair of opposed longitudinal grooves in its outer surface extending from its lower end to a point beyond the socket. The starter-driver bar and rod extensions have axial holes therethrough so that a suction or water can be provided at the lower end of the assembly. When a suction is to be applied the sockets have at least one hole through its wall which is not covered by the drill shank, but which is covered by the male end of the rod extension. When water is to be applied this hole is omitted and the water passes through the longitudinal grooves in the bit shank. A starter hole is first drilled using the starter-driver with the drill bit in its top and a motor connected to its lower end. Drilling then is continued with an assembly consisting of a first rod extension between the bit and starter-driver. Additional rod extensions are inserted between the starter-driver and the bottom rod extension until a hole of the desired depth is obtained.

15 Claims, 12 Drawing Figures

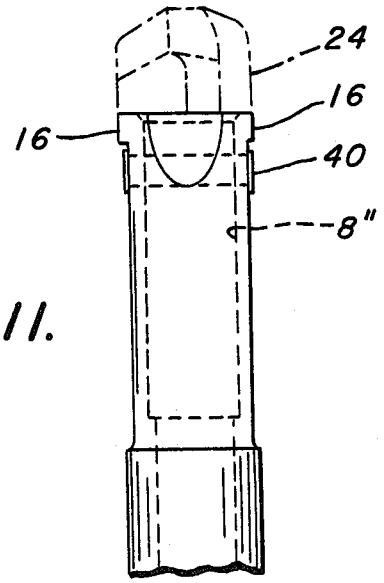
FIG. 11.
FIG. 12.
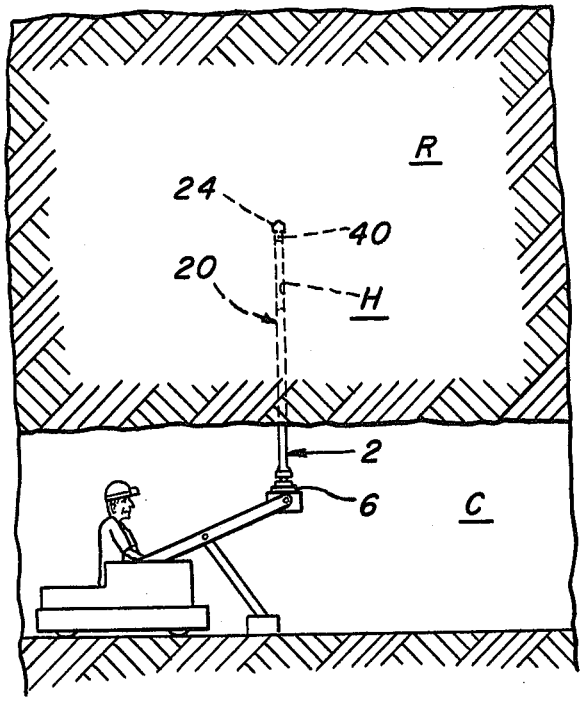

METHOD AND APPARATUS FOR ROOF DRILLING

This application is a continuation-in-part of our copending application Ser. No. 683,986 filed May 6, 1976, now U.S. Pat. No. 4,009,760, which in turn is a continuation of Ser. No. 554,878 filed Mar. 3, 1975, now abandoned.

This invention relates to a method and apparatus for roof drilling and more particularly to the drilling of holes in the roof of mine chambers where the depth of the hole is greater than the height of the chamber and water or vacuum is supplied to the vicinity of the drilling to prevent the dust formed from causing damage. The apparatus used in the conventional method of drilling such holes, in addition to the bit and motor, includes a tubular starter rod, a tubular driver, a tubular lead extension and a tubular middle extension. In drilling the hole, the lower end of the starter rod is connected to the motor and the bit is secured in a socket in the top of the starter rod. The hole is then drilled to a depth as great as practical or possible with water or vacuum being supplied to the vicinity of the drilling. The starter rod and bit are then removed and the lead extension connected to the bit and the driver. The drilling of the hole is then continued until it reaches a depth as great as practical or possible. The drive and lead extension are then separated and a middle extension inserted therebetween and the drilling continued. Additional middle extensions are inserted as required.

It will be seen that four types of drill rods are used which require that some of each be kept in stock. Since it is necessary for the operator to be constantly changing rods, his efficiency is low. The efficiency is also lowered because of the number of times the entire assembly must be removed from the hole and another assembly reinserted.

Other art of which we have knowledge are U.S. Pat. Nos. 3,519,091; 2,757,906; 2,771,273; 3,187,825; 3,218,893; 3,460,638; 3,554,306; 3,604,754; 3,774,556; 3,830,318; and 3,840,272. These have various shortcomings.

Our parent application discloses a method and apparatus for roof drilling in which a vacuum is used to remove the dust and cuttings from the vicinity of the drilling operation. While the apparatus disclosed therein has been used successfully we have found that better results are obtained if the opening from the assembly adjacent the bit is closer to the bit.

Where conditions permit it is desirable to introduce a wet lubricant, such as water or an air-mist, to the cutting edge of the bit and this is not possible with the apparatus disclosed in our parent application.

It is therefor an object of our invention to provide a roof drilling assembly which requires fewer pieces than formerly and which efficiently removes the dust of the drilling operation.

Another object is to provide such apparatus which can deliver a wet lubricant or apply a vacuum very close to the drilling operation.

Still another object is to provide a bit which enables the wet lubricant or vacuum to be applied very close to the drilling operation.

A further object is to provide a safer and more efficient method of drilling a roof hole.

These and other objects will be more apparent after referring to the following specification and attached drawings in which:

FIG. 11 is a view of a modified socket; and

FIG. 12 is a schematic elevation showing a drill assembly in place in a mining chamber.

Figure 3:
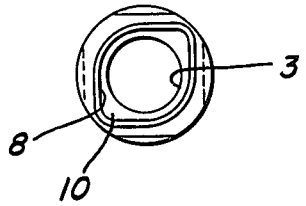
FIG. 3 is a top plan view of FIG. 1.
Figure 5:
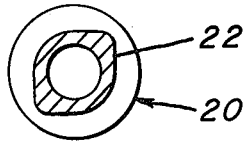
FIG. 5 is a view taken on the line V—V of FIG. 4.
Figure 1:
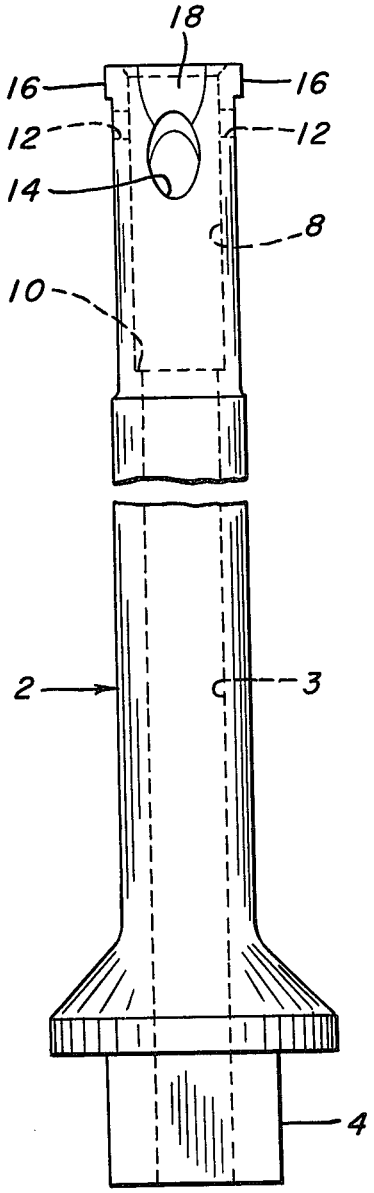
FIG. 1 is an elevation of the starter-driver of our invention.
Figure 2:
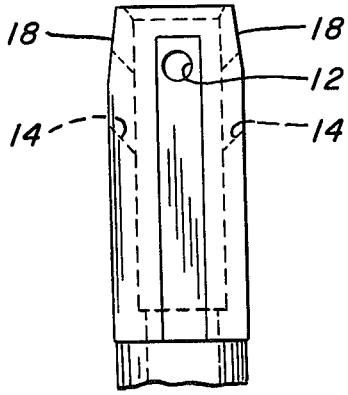
FIG. 2 is an elevation of the socket portion of FIG. 1 taken at right angles thereto.
Figure 4:
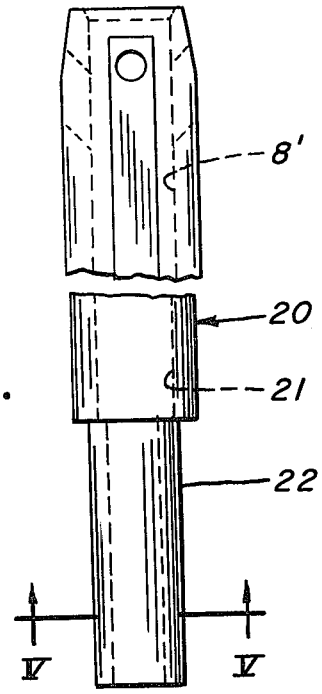
FIG. 4 is an elevation of the rod extension of our invention.
Figure 6:
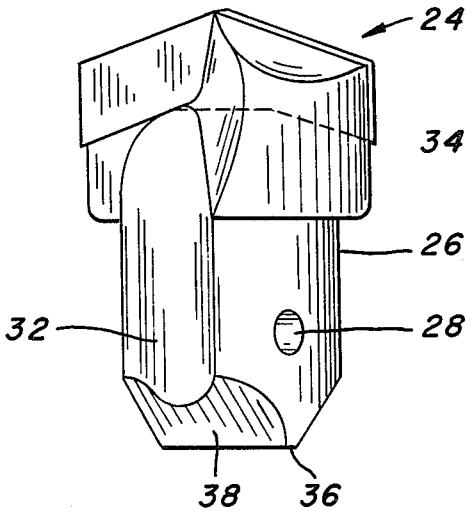
FIG. 6 is an elevation of the drilling bit of our invention.
Figure 7:
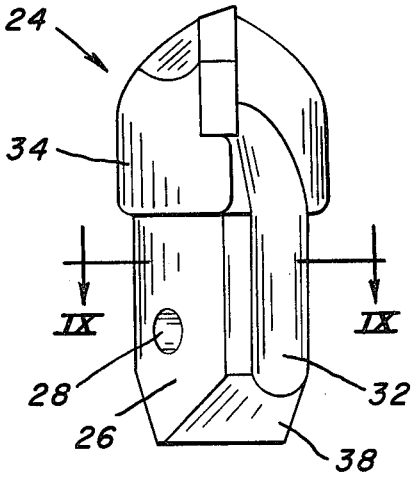
FIG. 7 is an elevation of the drilling bit of our invention looking from the right of FIG. 6.
Figure 8:
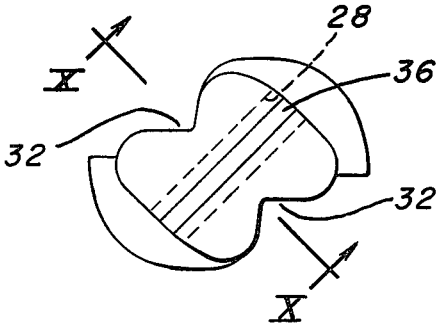
FIG. 8 is a bottom view of the shank of the bit of FIG. 6.
Figure 9:
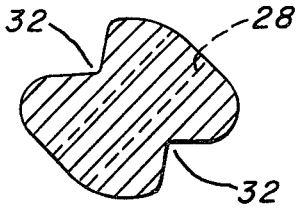
FIG. 9 is a view taken on line IX—IX of FIG. 7.
Figure 10:
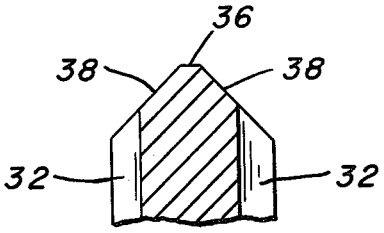
FIG. 10 is a view taken on line X—X of FIG. 8.

Referring more particularly to the drawings, reference numeral 2 indicates the starter-driver bar of our invention having an axial hole 3 therethrough. Shank 4 at one end of the starter-driver 2 is shaped to be driven by a motor 6. The other end of starter-driver has a female socket 8 therein. It will be seen that the socket 8 has a non-circular shape and has a shoulder 10 at its inner end. Aligned holes 12 are provided through the walls of socket 8 and a pair of opposed transverse holes 14 are provided adjacent the holes 12. It will be seen that holes 14 slope outwardly and upwardly at an angle of 45°. Flanges 16 providing raised outer surfaces extending radially beyond the surface where holes 12 exit are provided at the top of socket 8 for a purpose which will appear later. The outer periphery of the upper part of socket 8 adjacent holes 14 taper upwardly and inwardly at 18. A rod extension 20 having an axial hole 21 therethrough includes a male end 22 and a female socket 8′ at its other end. The male end 22 has a cross section of such size and shape as to be received snugly in socket 8 or socket 8′ of another rod extension. Sockets 8 and 8′ are identical so that socket 8′ will not be described in detail.

The drill bit 24 may be made in one piece or may have a carbide insert as shown. Drill bit 24 includes a shank 26 having a cross-section essentially the same as male end 22. This means that it will fit in the sockets 8 or 8′ with sufficient of its outer surface contacting the inner wall of the socket to provide a good driving connection. A hole 28 is provided through shank 26 such that it will be in alignment with holes 12 when inserted into socket 8 or 8′. Shank 26 has diametrically opposed longitudinal grooves 32 extending the length thereof into bit body 34. Except for these grooves the bit body is coventional. The bottom of shank 26 has a central narrow flat surface 36 and tapered sides 38 extending upwardly therefrom at an angle of 45°. It will be seen that the arrangement of the holes 12, 14 and 28 and the shape of the socket and bit shank are such that the holes 14 will be in alignment with the grooves 32 and sides 38 when a locking pin 40 is inserted through the aligned holes to retain the bit in the socket. The flanges 16 extend radially beyond the ends of pins 40 so as to protect the pins 40 from damage due to contact with the sides of the hole being drilled. As is conventional a suction is applied to the bottom of bar 2 to suck dust through holes 14 downwardly through the bar 2 and rod extensions 20. The described arrangement permits the suction to be applied closer to the drilling than in our co-pending application with subsequent better removal of the dust. Like in our co-pending application, the holes 14 are covered by the male ends 22 when inserted into sockets 8 and 8'.

When drilling a hole H in a roof R to a depth greater than chamber C, the bit 24 is inserted in socket 8 and the lower end of starter-driver 2 connected to motor 6. A hole is then drilled as deep as practical after which the bit is removed from socket 8 and the end 22 of a rod extension 20 inserted in place thereof. The bit 24 is then inserted in socket 8' and the drilling is continued to as great a depth as possible. This is the assembly shown in FIG. 12. To continue the drilling it is not necessary to remove the bit 24 and extension 20 from the hole. It is only necessary to add an additional rod extension 20 between the starter-driver 2 and the first rod extension. This operation is continued until the desired depth of hole is obtained. Each time it is only necessary to add an additional rod extension between the starter-driver and lowest rod extension.

When a liquid lubricant such as water is to be applied adjacent the drilling operation to act as a lubricant and coolant for the bit and to mix with the dust the sockets 8 and 8' are modified as shown in FIG. 11. As there shown, sockets 8'' are identical to sockets 8 and 8' except that the transverse holes 14 are omitted. Thus the water is delivered to the bit body through the grooves 32 to a position adjacent the cutting edge of the bit where dust is being formed, thus acting very efficiently. The water is delivered to the starter-driver in the usual way. Otherwise the operation is as in the first embodiment.

In some instances such as when the material removed from the roof does not readily flow or fall downwardly the starter-driver and rod extensions may be modified by having an augur outer surface. The construction and operation will otherwise be the same as in the first two embodiments.

While several embodiments have been shown and described, it is to be understood that various adaptations and modifications may be made within the scope of the invention.

We claim:

1. In a roof drilling assembly comprising a starter-driver bar including a first end adapted to be driven by a motor and a second end having a female socket therein, a rod extension having a male end shaped to be received in said female socket and a female socket at its other end of the same cross-sectional size and shape as the first named female socket, and a bit having a male shank of the same general cross-sectional shape as said male end and a head portion, said sockets, male end and shank being noncircular in transverse cross-section, each of said starter-driver bar and rod extension having an axial hole therethrough; the improvement comprising at least one longitudinal groove in the outer surface of said bit shank extending from the end remote from said head portion to a point beyond the socket when the bit is in said socket.

2. The assembly of claim 1 including a pair of tapered sides on said shank portion extending from said remote end outwardly toward said head portion.

3. The assembly of claim 1 in which each socket has aligned holes through its walls, and each shank and male end has a hole therethrough adapted to be aligned with the corresponding aligned holes in the corresponding socket to receive a locking pin.

4. The assembly of claim 3 in which each socket end includes a raised outer surface extending radially beyond the outer ends of said locking pin.

5. The assembly of claim 3 in which the walls of said sockets are imperforate except for the locking pin holes.

6. The assembly of claim 3 in which each socket has a transverse hole through its wall adjacent said locking pin holes, said transverse hole being open to said axial hole therein when said bit is in said socket.

7. The assembly of claim 1 in which each socket has a pair of opposed transverse holes through its wall adjacent the top thereof extending upwardly and outwardly at approximately the same angle as the tapered sides of said shank portion, said tapered sides being in approximate alignment with the top of said transverse holes when said bit is received in said socket.

8. The method of drilling a hole in a mine chamber roof to a greater depth than the height of the chamber below the roof which comprises providing a starter-driver bar including a first end adapted to be driven by a motor and a second end having a female socket therein, a plurality of rod extensions each having a male end shaped to be received in said female socket and a female socket at its other end of the same cross-sectional size and shape as the first named female socket, a bit having a male shank of essentially the same cross-sectional shape as said male end and having at least one longitudinal groove in its outer surface extending from its lower end to a point beyond said socket, each of said starter-driver bar and rod extensions having an axial hole therethrough, securing the bit shank in the female socket of said starter-driver and connecting the first end of the starter-driver to said motor to provide a first assembly, then drilling a hole in said roof with said first assembly while passing water from the bottom of said starter-driver through said axial hole therein and discharging the water through said longitudinal groove, then separating said bit from said starter-driver, then securing the bit in the female socket of a first rod extension and the male end of said first rod extension in the socket of said starter-driver, and then continuing drilling said hole while supplying water to the bottom of said starter-driver bar.

9. The method of claim 8 which includes the additional steps of securing rod extension between the first rod extension and said starter-driver, and then continuing drilling said hole.

10. The method of claim 8 which includes the additional steps of securing additional rod extensions between the starter-driver and the lowest rod extension, and after each addition continue drilling said hole until it reaches the desired depth.

11. The method of drilling a hole in a mine chamber roof to a greater depth than the height of the chamber below the roof which comprises providing a starter-driver bar including a first end adapted to be driven by a motor and a second end having female socket therein, a plurality of rod extensions each having a male end shaped to be received in said female socket and a female socket at its other end of the same cross-sectional size and shape as the first named female socket, a bit having a male shank of essentially the same cross-sectional shape as said male end and having a pair of opposed longitudinal grooves in its outer surface extending from its lower end to a point beyond said socket and a pair of tapered sides of said shank extending outwardly from its lower end, each of said starter-driver bar and rod extensions having an axial hole therethrough, each of said sockets having a pair of opposed transverse holes through its wall adjacent its top extending upwardly at an angle substantially the same as the angle of said tapered side, and securing the bit shank in the female socket of said starter-driver with the top of said transverse holes being in general alignment with said tapered sides, connecting the first end of the starter-driver to said motor to provide a first assembly, then drilling a hole in said roof with said first assembly while applying suction to the bottom of said starter-driver bar, then separating said bit from said starter-driver, then securing the bit in the female socket of a first rod extension and the male end of said first rod extension in the socket of said starter-driver, said male end of said first rod extension covering the transverse holes of the female socket of said starter-driver bar, and then continuing drilling said hole while applying suction to the bottom of said starter-driver bar.

12. The method of claim 11 which includes the additional steps of securing a second rod extension between the first rod extension and said starter-driver, and then continuing drilling said hole.

13. The method of claim 11 which includes the additional steps of securing additional rod extensions between the starter-driver and the lowest rod extension, and after each addition continue drilling said hole until it reaches the desired depth.

14. A bit comprising a shank portion, a head portion connected to the shank portion with a flat shoulder therebetween extending radially outward from the shank portion in a plane perpendicular to the axis of the bit, said shank portion having a pair of diametrically opposed longitudinal grooves in its outer surface extending from the end remote from the head portion into said head portion, said shank portion being non-circular in cross-section between said grooves, and a pair of tapered sides on said shank portion extending from said remote end outwardly toward said head portion in alignment with said longitudinal grooves.

15. A bit according to claim 14 including a hole extending through said shank portion between said longitudinal grooves and adapted to receive a positioning pin.

* * * * *